US006053734A

United States Patent [19]

Savill

[11] Patent Number: 6,053,734

[45] Date of Patent: Apr. 25, 2000

[54] TOOTHBRUSH AND METHOD OF CLEANING TEETH

[75] Inventor: Derek Guy Savill, Bebington, United Kingdom

[73] Assignee: Chesebrough-Pond's USA Co., Greenwich, Conn.

[21] Appl. No.: 09/124,267

[22] Filed: Jul. 29, 1998

[30] Foreign Application Priority Data

Aug. 1, 1997 [GB] United Kingdom ..... 9716394

[51] Int. Cl.[7] ..... A61C 17/00; A46B 9/04

[52] U.S. Cl. ..... 433/216; 15/167.1; 15/207.2; 428/364; 428/373; 428/395

[58] Field of Search ..... 15/167.1, 207.2; 428/364, 373, 395; 433/216

[56] References Cited

U.S. PATENT DOCUMENTS

| | | | |
|---|---|---|---|
| 4,263,691 | 4/1981 | Pakarnseree | 15/207.2 |
| 4,526,735 | 7/1985 | Norota et al. | 263/450 |
| 4,610,925 | 9/1986 | Bond | 15/207.2 X |
| 4,751,760 | 6/1988 | Norota | 15/207.2 |
| 5,588,447 | 12/1996 | Gueret | 132/200 |

FOREIGN PATENT DOCUMENTS

| | | |
|---|---|---|
| 0 745 711 | 5/1996 | European Pat. Off. . |
| 96/23431 | 8/1996 | WIPO . |

*Primary Examiner*—Mark Spisich
*Attorney, Agent, or Firm*—Milton L. Honig

[57] ABSTRACT

A toothbrush having filaments which comprise poly (trimethylene terephthalate).

20 Claims, 1 Drawing Sheet

TOOTHBRUSH AND METHOD OF CLEANING TEETH

BACKGROUND OF THE INVENTION

1. Field of the Invention

This invention relates to a toothbrush, and in particular to a toothbrush having an improved form of bristles.

2. The Related Art

It has long been known to use toothbrushes in the cause of dental hygiene, as a way of both cleaning the mouth, and also introducing a degree of freshness into the mouth. Toothbrushes typically comprise a head with a handle, with the head having a number of tufts which are used to do the actual cleaning. Typically the head comprises a number of bristle tufts which are arranged in an appropriate configuration. The bristle tufts are actually made up of a number of individual bristles which can be anchored into the brush head in any appropriate manner.

Conventional toothbrushes typically have bristles made of a synthetic material such as nylon. The nylon bristles are typically held in place in the head of the toothbrush by pins, each pin being used to anchor in place the bristles in one tuft, where the bristles in any given tuft being a number of lengths of nylon which folded in two and anchored in the middle by the pin. Once all the bristles are fixed in position in the head of the toothbrush, the distal ends of the bristles are trimmed to any convenient shape and size by known processes, for example by a revolving blade. The ends of the bristles can be of different forms to provide different cleaning benefits.

This known type of toothbrush has bristles made from nylon filaments, commonly nylon 6,12 filaments typically having a diameter of 0.15–0.25 mm, often 0.2 mm, this thickness being necessary to provide the necessary stiffness to the bristles to enable sufficient tooth cleaning to be carried out. This diameter also represents the minimum distance that can exist between bristles, and hence influences the actual area of contact between the bristles and the tooth surface. This contact area is important since the larger it is, the more efficient is the cleaning. When cleaning flat tooth surfaces with a new brush, the contact is primarily between bristle tips and the surface. In this case the actual contact area is given by the sum of individual contact areas between each bristle tip and the tooth surface. These individual contact areas result from elastic deformation of the rounded bristle tips. Finer filaments enable toothbrushes to be constructed with denser tufts and increased actual areas of contact; Such brushes are therefore more efficient.

SUMMARY OF THE INVENTION

The present invention provides in its first aspect a toothbrush in which the filaments of the brush comprise poly (trimethylene terephthalate) (PTT).

PTT is commercially available as a resin from Shell Chemical Company, One Shell Plaza, PO BOX 2463, Houston, Tex. 77252-2463. PTT resin can be processed into filaments in a conventional manner, using known materials, and can be drawn into the appropriate diameter filaments using known techniques. PTT filaments are available commercially from Shakespeare Monofilament Division, 611 Shakespeare Road, PO Box 4060, Columbia, S.C. 29240, U.S.A.

In such a toothbrush, the body of the brush (i.e. the head and handle) can be made with conventional methods such as injection moulding, and using conventional materials. The filaments can also be attached to the brush head by known techniques, for example by fixing the bristles to the head by means of pins.

Two properties dictate whether a polymer is suitable as a toothbrush bristle component. First the flexural stiffness and second the flexural recoverability. These properties also dictate the size of the bristles, e.g. a bristle comprising a polymer with high flexural stiffness and recoverability will be stiffer than one with a low flexural stiffness and recoverability thus allowing the bristles to be thinner, allowing more bristles to be packed together, thus providing a greater surface contact area.

The flexural stiffness is determined by the axial elastic modulus of the drawn polymer. This modulus is about 3 GPa for both dry nylon 6,12 and PTT. However, water plasticises nylon 6,12 and this results in about a 40% loss in axial elastic modulus and, therefore, stiffness. In contrast, the effect of water on PTT is negligible. This means that PTT filament of 180 $\mu$m diameter will have about the same wet stiffness as 200 $\mu$m diameter nylon bristles. Toothbrushes appropriately constructed using PTT filament therefore offer a measure of improved cleaning efficiency over nylon equivalents because for a given flexural stiffness, they can be slightly thinner than nylon 6,12 bristles. They can, therefore, be packed closer together and provide a greater surface contact area.

Flexural recoverability correlates to the tensile recoverability which is a standard industrial statistic for a material. A material with a high tensile recoverability will be able to resist splaying when used as a toothbrush bristle material. Splay is the permanent bristle deformation that results from the cyclical flexural strains induced during the toothbrushing process. Tensile recoverability and, therefore, splay resistance is determined both by the type of polymer and how it is processed.

On the basis of the above, any ideal filament material would have both a relatively high flexural elastic modulus as well as an excellent flexural recoverability.

Unfortunately, commonly used polymeric filaments with a high axial elasticity modulus, such as high molecular weight polyethylene and Kevlar, have poor flexural recoverability.

We have surprisingly found that PTT exhibits a superior flexural recoverability while having a similar axial elasticity modulus to nylon 6,12. We have also found that some polymeric materials with a similar structure to PTT, e.g. poly(ethylene terephthalate) (PET) and poly(butylene terephthalate) (PBT) have significantly poorer flexural recoverability than PTT.

In certain embodiments of the invention, the filaments may comprise solely drawn PTT. However, in other envisaged embodiments of the invention, PTT can be coextruded with other polymers, for example polymers which have a high flexural elastic modulus. An example of such a coextrusion polymer is PET, which can be made with a higher flexural elastic modulus (10 GPa) than other polymers, such as PBT (3 GPa). Of the possible coextrusions, a preferred embodiment is that filaments are coextruded with a PET core and a PTT sheath, with coextrudates generally offering a balance between cleaning efficiency and splay resistance to be optimised for a given toothbrush.

As an alternative to coextrudate of polymer with PTT or to sheath/core coextrudates, it is also envisaged that coextruded fibres can be made of PTT with another polymer, for example PET, in which the streams of the PTT and the other polymer are coextruded side by side. By doing this, it is possible to produce a coextruded polymer which can have controlled splitting at the ends; which can lead to improved surface contact area during cleaning. It is also possible to coextrude with polymers which expands on contact with water, such as nylon 6,12. If such coextrudates are made, this expansion may cause the filaments to progressively flex on contact with water. As such, during toothbrushing, this flexing allows the bristles to clean areas of teeth which would otherwise not be cleaned.

It is also an envisaged embodiment of the invention that a PTT fibre or coextrudate could be made to have a hollow core. The cross-section of the bristles in a toothbrush according to the invention may be any regular or irregular shape, e.g. circular, oval, rectangular, star-shaped, triangular, etc.

BRIEF DESCRIPTION OF THE DRAWING

The sole FIGURE illustrates a toothbrush head and demonstrates how filaments of the present invention are according to a preferred embodiment fixed into position on the head.

DETAILED DISCUSSION

Figure 1:
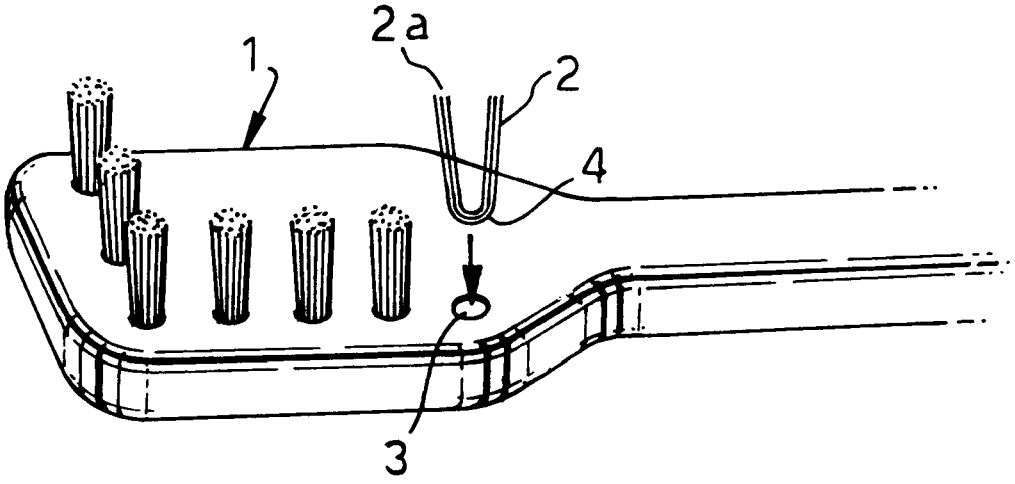

The invention will now be described in further detail, by way of example.

EXAMPLE 1

The tensile mechanical properties of monofilaments were evaluated using a displacement-controlled tensile/compression instrument (Instron 5566). A 50 mm gauge length of the filament was mounted vertically in the instrument using compression grips. One grip was attached to a fixed point at the bottom of the instrument and the other was attached to a the load cell which was mounted underneath the moving crosshead of the instrument. The developed tensile force was then continually monitored as the filament was stretched at 50 mm/min until fracture of the filament occurred. The raw force/displacement data were converted to stress/strain data using the initial cross-sectional area and length of the specimen. The axial elastic modulus was calculated from the slope of the stress/strain curve in the region from 0–2% strain. This slope was calculated using the least squares method.

Typical values measured in this way at 20° C. and 45% relative humidity were:

| Polymer | Supplier | Diameter (μm) | Elastic Modulus (GPa) |
|---|---|---|---|
| PET | Hoechst | 200 | 7.6 |
| Nylon 6,12 | Du Pont | 157 | 3.4 |
| PBT | Whiting | 178 | 3.2 |
| PTT | Shakespeare Monofilament | 175 | 3.0 |
| PTT | Shakespeare Monofilament | 208 | 2.7 |

EXAMPLE 2

The flexural recoverability of a polymer can be ascertained by measuring the tensile recoverability.

For tensile recoverability measurements, each 50 mm specimen was stretched at 20 mm/min until a strain of 20% was imposed. The specimen was then allowed to stress-relax at this 20% strain for 2 minutes before the crosshead was moved back at 20 mm/min in order to allow the specimen to start to recover from the imposed deformation. The length at which the force first drops to zero during this process gives a measure of the immediate residual extension which can be converted to the immediate residual strain by dividing it by the initial gauge length. After a further five minutes holding at 0% strain, the crosshead was again moved at 20 mm/min to restretch the specimen. The length at which the force rises above zero during this process gives a measure of the recovered length after a further 5 minutes of recovery at 0% strain. This can be assumed to give a measure of the final residual extension which can be converted to the final residual strain by dividing it by the initial gauge length.

The initial recoverability is then calculated through:

$$\%\ \text{Immediate recoverability} = \frac{100 \times (\text{initial imposed strain} - \text{immediate residual strain})}{\text{initial imposed strain}}$$

The final recoverability is then calculated through:

$$\%\ \text{Final recoverability} = \frac{100 \times (\text{initial imposed strain} - \text{final residual strain})}{\text{initial imposed strain}}$$

Typical values measured in this way for an initial imposed strain of 0.2 were:

| Polymer | Diameter (μm) | % Initial recoverability | % Final recoverability |
|---|---|---|---|
| PTT | 175 | 90.4 | 99.8 |
| PTT | 208 | 87.5 | 99.2 |
| PBT | 178 | 73.8 | 84.3 |
| Nylon 612 | 157 | 54.6 | 67.5 |
| PET | 200 | 25.1 | 38.9 |

It can be seen that PTT monofilament is almost completely recoverable from an imposed strain of 20%.

It can clearly be seen that while the tensile recoverability measurements of nylon, PET and PBT are low, the value for PTT is surprisingly high.

With reference to the accompanying drawing, the single FIGURE of which is a simplified, partially exploded perspective view of the head of a toothbrush constructed in accordance with the invention.

Referring to the drawing, a toothbrush head 1 is made of a plastics material such as polyethylene, and is injection molded using standard techniques. The bristles can be anchored into the brush head using known techniques, such as anchoring doubled up lengths of the bristle into the head 1 by means of pins 3. Each pin 3 is associated with a number of pairs of bristles 2 constituted by single PTT filaments folded back on themselves, with the pin passing through the folded portions 4 of the filament. Once all the bristles 2 are fixed in position in the head 1, the distal ends 2*a* of the bristles are trimmed to the desired shape and size using known techniques.

The PTT filaments have a diameter of 0.18 mm, and can be made by any known method, such as the melt-spinning, cooling and drawing method described in EP-A-0 745 711 (Shell). Although any known way of producing PTT can be used to make suitable fibres for use as toothbrush bristles, this application describes a preferred method. The bristles in this embodiment are solid core PTT, though as described above coextrudates and hollow core filaments which comprise PTT are envisaged.

What is claimed is:

1. A toothbrush comprising a head and a handle extending therefrom, the head sized for cleaning in a mouth and having bristle tufts formed of filaments, the filaments comprising poly(trimethylene terephthalate).

2. A toothbrush according to claim 1, wherein the filaments are made solely of poly(trimethylcene terephthalate).

3. A toothbrush according to claim 1, wherein the filaments are coextrudates of poly(trimethylene terephthalate) with another polymeric material.

4. A toothbrush according to claim 3, wherein the filaments are side by side coextrudates.

5. A toothbrush according to claim 3, wherein the filaments are a coextrudate of poly(trimethylene terephthalate) and a material having a higher axial elastic modulus than poly(trimethylene terephthalate).

6. A toothbrush according to claim 5, wherein the material having a higher axial elastic modulus than poly(trimethylene terephthalate) is poly(ethylene terephthalate).

7. A toothbrush according to claim 3, wherein the said another polymeric material is nylon.

8. A toothbrush according to claim 1, wherein each filament has a core of one polymeric material and a sheath of another polymeric material.

9. A toothbrush according to claim 8, wherein the core is poly(ethylene terephthalate) and the sheath is poly (trimethylene terephthalate).

10. A toothbrush according to claim 1, wherein each filament has a hollow core.

11. A method of cleaning teeth comprising:

a) providing a toothbrush comprising a head and a handle extending therefrom, the head sized for cleaning in a mouth and having bristle tufts formed of filaments, the filaments comprising poly(trimethylene terephthalate);

b) brushing the teeth with the bristle tufts.

12. A method according to claim 11 wherein the filaments are made solely of poly(trimethylene terephthalate).

13. The method according to claim 11 wherein the filaments are coextrudates of poly(trimethylene terephthalate) with another polymeric material.

14. The method according to claim 13 wherein the filaments are side by side coextrudates.

15. The method according to claim 13 wherein the filaments are coextrudates of poly(trimethylene terephthalate) and a material having a higher axial elastic modulus than poly(trimethylene terephthalate).

16. The method according to claim 15 wherein the material having a higher axial elastic modulus than poly (trimethylene terephthalate) is poly(ethylene terephthalate).

17. The method according to claim 13 wherein said another polymeric material is nylon.

18. The method according to claim 11 wherein each of the filaments has a core of one polymeric material and a sheath of another polymeric material.

19. The method according to claim 18 wherein the core is poly(ethylene terephthalate) and the sheath is poly (trimethylene terephthalate).

20. The method according to claim 11 wherein each of the filaments has a hollow core.

* * * * *

UNITED STATES PATENT AND TRADEMARK OFFICE

CERTIFICATE OF CORRECTION

PATENT NO. : 6,053,734
DATED : April 25, 2000
INVENTOR(S) : Savill

It is certified that error appears in the above-identified patent and that said Letters Patent is hereby corrected as shown below:

Title page, Item 73,

In the Assignee Section change "Chesebrough-Pond's USA Co.," to read - - Chesebrough-Pond's USA, Co., Division of Conopco, Inc. - -

Signed and Sealed this

Twentieth Day of March, 2001

Nicholas P. Godici

*Attest:*

NICHOLAS P. GODICI

*Attesting Officer*

*Acting Director of the United States Patent and Trademark Office*